US010024588B2

(12) United States Patent
Tamura et al.

(10) Patent No.: US 10,024,588 B2
(45) Date of Patent: Jul. 17, 2018

(54) AIR-CONDITIONING APPARATUS AND CONTROL METHOD THEREFOR

(71) Applicants: Naomichi Tamura, Tokyo (JP); Tadashi Ariyama, Tokyo (JP)

(72) Inventors: Naomichi Tamura, Tokyo (JP); Tadashi Ariyama, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 702 days.

(21) Appl. No.: 13/852,095

(22) Filed: Mar. 28, 2013

(65) Prior Publication Data

US 2014/0165628 A1 Jun. 19, 2014

(30) Foreign Application Priority Data

Dec. 14, 2012 (JP) ..... 2012-273904

(51) Int. Cl.
*F25B 49/02* (2006.01)
*F25B 47/02* (2006.01)

(52) U.S. Cl.
CPC ..... *F25B 47/022* (2013.01); *F25B 49/02* (2013.01); *F25B 49/022* (2013.01)

(58) Field of Classification Search
CPC ..... F25B 47/022; F25B 38/028
See application file for complete search history.

(56) References Cited

U.S. PATENT DOCUMENTS 2,048,711 A * 7/1936 Ridge ..... F24F 5/0003 236/44 R
3,138,007 A * 6/1964 Friedman ..... F25B 5/00 62/116

(Continued)

FOREIGN PATENT DOCUMENTS

JP H04-110576 A 4/1992
JP 10-205932 A 8/1998

(Continued)

OTHER PUBLICATIONS

Office Action dated May 24, 2016 issued in the corresponding Japanese Patent Application No. 2012-273904 (and English translation).

(Continued)

*Primary Examiner* — Ljiljana Ciric
*Assistant Examiner* — Alexis Cox
(74) *Attorney, Agent, or Firm* — Posz Law Group, PLC

(57) ABSTRACT

An air-cooled air-conditioning apparatus including a heat source side heat exchanger comprising a plural number of heat source side heat exchanger parts that are connected together, and each of the heat source side heat exchanger parts is connected by a corresponding flow switching valve to a compressor. The air-cooled air-conditioning apparatus includes a controller configured to perform a defrosting operation in which a refrigerant discharged from the compressor is caused to flow separately through each of the heat source side heat exchanger parts by opening and closing the corresponding flow switching valves. The controller performs the defrosting operation on the basis of the heat exchanger capacity of each of the heat source side heat exchanger parts, the necessary heating capacity of each of the heat source side heat exchanger parts, and the arrangement of the heat source side heat exchanger parts.

8 Claims, 2 Drawing Sheets

(56) References Cited

U.S. PATENT DOCUMENTS 3,234,753 A * 2/1966 Quick ..... F25B 1/10 62/196.2
3,427,819 A * 2/1969 Seghetti ..... F25B 5/02 62/196.4
3,464,226 A * 9/1969 Kramer ..... F25B 5/02 62/196.1
3,513,664 A * 5/1970 Duffney ..... F25B 1/00 62/196.2
3,638,444 A * 2/1972 Lindahl ..... F25B 47/025 62/151
3,651,548 A * 3/1972 Behn ..... H01G 4/30 29/25.42
4,510,767 A * 4/1985 Komatsu ..... F25B 5/02 62/200
5,460,008 A * 10/1995 Ott ..... F25B 49/022 62/175
5,520,006 A * 5/1996 Middleton ..... F25D 13/067 62/152
5,586,444 A * 12/1996 Fung ..... F25B 49/022 318/610
6,006,527 A * 12/1999 Hansen ..... F25B 5/02 236/75
6,318,087 B1 * 11/2001 Baumann ..... B01D 5/0069 60/657
7,992,396 B2 * 8/2011 Thybo ..... F25B 5/02 62/155
8,424,333 B2 * 4/2013 Yoon ..... F24F 1/32 62/152
2004/0093893 A1 * 5/2004 Tanimoto ..... F25B 1/10 62/510
2004/0168467 A1 * 9/2004 Nuiding ..... F25B 5/00 62/525
2005/0097918 A1 * 5/2005 Thurman ..... A47F 3/04 62/468
2007/0119196 A1 * 5/2007 Wellman ..... F25B 47/022 62/151
2010/0170282 A1 * 7/2010 Kim ..... F24F 11/0086 62/276
2011/0066298 A1 * 3/2011 Francino ..... F01K 9/003 700/290
2011/0113805 A1 * 5/2011 Ko ..... F25B 13/00 62/234
2013/0145785 A1 * 6/2013 Nobuhiro ..... F25B 49/02 62/160
2014/0131010 A1 * 5/2014 Lee ..... F23L 15/045 165/104.15

FOREIGN PATENT DOCUMENTS

JP 2008-249236 A 10/2008
JP 2009-281698 A 12/2009

OTHER PUBLICATIONS

Office Action dated Jan. 10, 2017 issued in the corresponding Japanese Patent Application No. 2012-273904 (and English translation).

* cited by examiner

AIR-CONDITIONING APPARATUS AND CONTROL METHOD THEREFOR

CROSS REFERENCE TO RELATED APPLICATION

This application is based on Japanese Patent Application No. 2012-273904 filed on Dec. 14, 2012, the disclosure of which is incorporated herein by reference.

TECHNICAL FIELD

The present invention relates to an air-conditioning apparatus, and more specifically, it relates to control during a defrosting operation and a control method for the air-conditioning apparatus.

BACKGROUND

In air-cooled air-conditioning apparatuses in which reheating is performed using air in a heat source side heat exchanger, frost may attach to the heat source side heat exchanger during heating operation, and therefore it is common to periodically perform defrosting operation. Defrosting operation is performed by switching the flow path of a four-way valve to the heat source side heat exchanger side, and therefore a heating operation by a use side heat exchanger cannot be performed during defrosting operation.

In order to solve this problem, a circuit and control method of an air-conditioning apparatus that performs a defrosting operation while continuing heating operation have been proposed (see Patent Literature 1).

PATENT LITERATURE

[Patent Literature 1] Japanese Unexamined Patent Application Publication No. 10-205932 (see, for example, [0009] to [0022], FIGS. 1 to 3).

However, in the air-conditioning apparatus described in Patent Literature 1, a heat exchanger for defrosting is required in addition to a heat source side heat exchanger. This makes the air-conditioning apparatus expensive. In addition, the order of defrosting is fixed regardless of the arrangement of heat exchangers and the heat exchanger capacity. Therefore, if partial defrosting operation is performed in an air-conditioning apparatus in which heat source side heat exchangers are arranged vertically, frost on the heat exchanger is melted into water by defrosting, flows down the fins, and falls in drops. If the dropped water comes into contact with frost on an undefrosted heat exchanger, the water forms bridges between the fins or freezes. As a result, the heat exchanger capacity is extremely reduced, or it takes a very long time to melt frost on the heat exchanger, and the heating capacity is thereby reduced.

SUMMARY

The present invention is made to solve the above problem, and it is an object of the present invention to provide an air-conditioning apparatus capable of reliably melting frost on the heat source side heat exchanger and maintaining the heating capacity.

An air-conditioning apparatus according to the present invention includes a compressor, first flow switching valves, a heat source side heat exchanger, second flow switching valves, a first expansion device, a use side heat exchanger, third flow switching valves, and a controller that controls the opening and closing of the first flow switching valves, the second flow switching valves, the third flow switching valves, and the first expansion device. The compressor, the first flow switching valves, the heat source side heat exchanger, the second flow switching valves, the first expansion device, and the use side heat exchanger are connected in series by pipes. The compressor, the third flow switching valves, the heat source side heat exchanger, and the first flow switching valves are connected in series by pipes. The heat source side heat exchanger is divided into a plurality of parts arranged vertically. The number of the first flow switching valves, the number of the second flow switching valves, and the number of the third flow switching valves are each equal to the number of the parts of the heat source side heat exchanger. The controller determines the order in which the parts of the heat source side heat exchanger are defrosted on the basis of the heat exchanger capacity of the parts of the heat source side heat exchanger, the necessary heating capacity of the parts of the heat source side heat exchanger, and the arrangement of the parts of the heat source side heat exchanger, controls the opening and closing of the first flow switching valves, the second flow switching valves, and the third flow switching valves accordingly, and performs defrosting operation in which a refrigerant discharged from the compressor is caused to flow through the heat source side heat exchanger.

In the air-conditioning apparatus according to the present invention, the order in which the parts of the heat source side heat exchanger are defrosted is determined on the basis of the heat exchanger capacity of the parts of the heat source side heat exchanger, the necessary heating capacity of the parts of the heat source side heat exchanger, and the arrangement of the parts of the heat source side heat exchanger, the opening and closing of the first flow switching valves, the second flow switching valves, and the third flow switching valves are controlled accordingly, and defrosting operation in which the refrigerant discharged from the compressor is caused to flow through the heat source side heat exchanger is performed. Therefore, frost on the heat source side heat exchanger can be reliably melted, and the heating capacity can be maintained.

DETAILED DESCRIPTION

Embodiment of the present invention will be described below with reference to the drawings.

Embodiment

Figure 1:
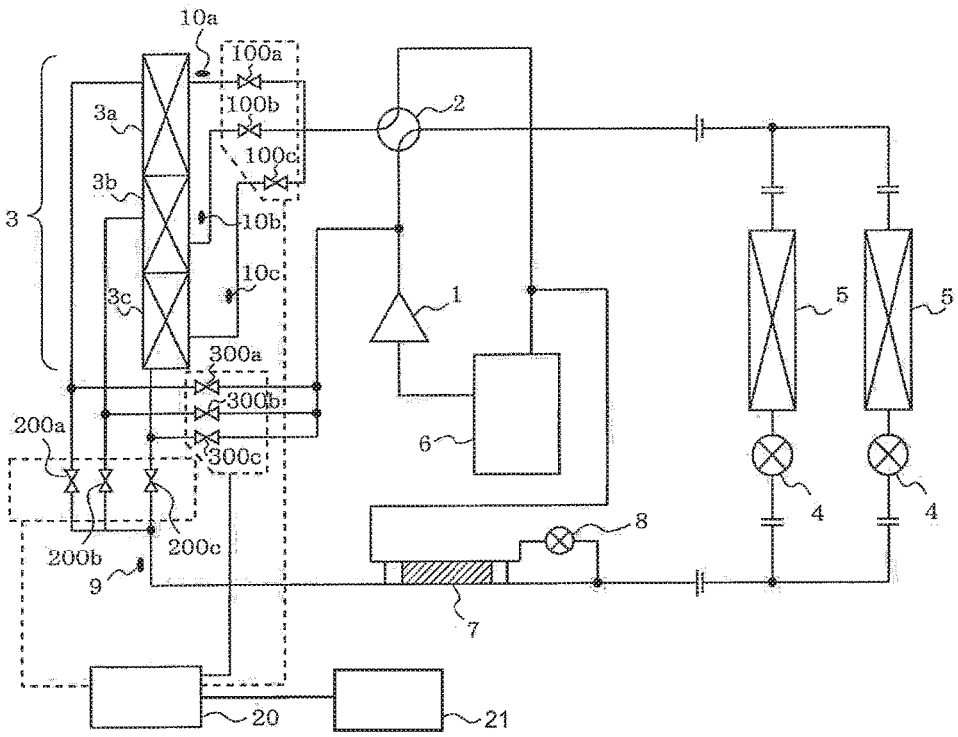
FIG. 1 is a circuit diagram schematically showing a refrigerant circuit configuration of an air-conditioning apparatus according to Embodiment of the present invention.
Figure 2:
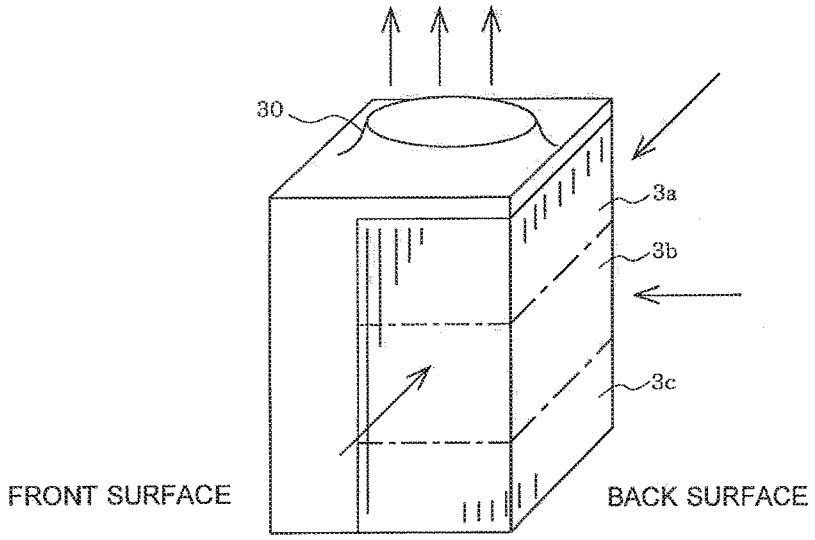
FIG. 2 is a perspective view of a heat source side heat exchanger of the air-conditioning apparatus according to Embodiment of the present invention.

FIG. 1 is a circuit diagram schematically showing a refrigerant circuit configuration of an air-conditioning apparatus according to Embodiment of the present invention. FIG. 2 is a perspective view of a heat source side heat exchanger of the air-conditioning apparatus according to Embodiment of the present invention.

(Configuration of Refrigerant Circuit)

In the refrigerant circuit of the air-conditioning apparatus according to Embodiment, a compressor 1, a four-way valve 2, a heat source side heat exchanger 3, a supercooling heat exchanger 7, a first expansion device 4, a use side heat exchanger 5, and an accumulator 6 are connected in this order by pipes in series. The compressor 1, the four-way valve 2, the heat source side heat exchanger 3, the supercooling heat exchanger 7, a second expansion device 8, and the accumulator 6 are connected in this order by pipes in series.

The heat source side heat exchanger 3 is divided into three parts: a first heat source side heat exchanger 3*a*, a second heat source side heat exchanger 3*b*, and a third heat source side heat exchanger 3*c*. In a vertical arrangement of the three parts of the heat source side heat exchanger 3 as shown in FIG. 2, the first heat source side heat exchanger 3*a* corresponds to an upper heat source side heat exchanger, the second heat source side heat exchanger 3*b* corresponds to a middle heat source side heat exchanger, and the third heat source side heat exchanger 3*c* corresponds to a lower heat source side exchanger. The pipes connecting them and the four-way valve 2 are provided with first flow switching valves 100*a* to 100*c*.

The pipes connecting the first heat source side heat exchanger 3*a*, the second heat source side heat exchanger 3*b*, and the third heat source side heat exchanger 3*c* of the heat source side heat exchanger 3, and the first expansion device 4 are provided with second flow switching valves 200*a* to 200*c*.

The pipes that branch from the pipe connecting the compressor 1 and the four-way valve 2 and that are connected so as to join the pipes connecting the heat source side heat exchanger 3 and the second flow switching valves 200*a* to 200*c* are provided with third flow switching valves 300*a* to 300*c*.

The supercooling heat exchanger 7 is connected to the pipe connecting the second flow switching valves 200*a* to 200*c* and the first expansion device 4, and the pipe that branches from the pipe connecting the second flow switching valves 200*a* to 200*c* and the first expansion device 4. After being connected to the supercooling heat exchanger 7, the branched pipe is connected so as to join the pipe connecting the four-way valve 2 and the accumulator 6. The second expansion device 8 is provided between a branching point of the branched pipe and the supercooling heat exchanger 7.

(Description of Each Component)

(Compressor)

The compressor 1 sucks a refrigerant, and compresses the refrigerant into a high-temperature and high-pressure state.

The type of the compressor 1 is not particularly limited as long as it can compress sucked the refrigerant into a high-pressure state. Various types of compressors, for example, a reciprocating compressor, a rotary compressor, a scroll compressor, or a screw compressor can be used.

(Four-Way Valve)

The four-way valve 2 switches the flow of the refrigerant. The four-way valve 2 has a function that switches between a cycle during cooling operation in which the refrigerant discharged from the compressor 1 is caused to flow from the heat source side heat exchanger 3 to the use side heat exchanger 5, and a cycle during heating operation and defrosting operation in which the refrigerant discharged from the compressor 1 is caused to flow from the use side heat exchanger 5 to the heat source side heat exchanger 3.

(Heat Source Side Heat Exchanger)

The heat source side heat exchanger 3 functions as an evaporator or a radiator (condenser), exchanges heat between air supplied from a fan 30 and the refrigerant, and evaporates and gasifies or condenses and liquefies the refrigerant. In Embodiment, as shown in FIG. 2, the first heat source side heat exchanger 3*a*, the second heat source side heat exchanger 3*b*, and the third heat source side heat exchanger 3*c* are arranged vertically, the fan 30 is rotated to suck air through the back surface and the side surfaces, and air that has been subjected to heat exchange is expelled upward through an air outlet provided in the first part.

The type of the heat source side heat exchanger 3 is not particularly limited as long as it can exchange heat between air supplied from the fan 30 and the refrigerant, and can evaporate and gasify or condense and liquefy the refrigerant. Various types of heat exchangers, for example, a cross fin tube type heat exchanger or a cross flow type heat exchanger can be used.

(First Expansion Device)

The first expansion device 4 has a function as a pressure reducing valve or an expansion valve, and depressurizes and expands the refrigerant. The first expansion device 4 is preferably one capable of changing the opening degree, for example, precise flow control means using an electronic expansion valve, or inexpensive refrigerant flow control means using a capillary tube or the like.

(Use Side Heat Exchanger)

The use side heat exchanger 5 functions as a radiator (condenser) or an evaporator, exchanges heat between air supplied from air-sending means (not shown) and the refrigerant, and condenses and liquefies or evaporates and gasifies the refrigerant.

The type of the use side heat exchanger 5 is not particularly limited as long as it can exchange heat between air supplied from the air-sending means (not shown) and the refrigerant, and can evaporate and gasify or condense and liquefy the refrigerant. Various types of heat exchangers, for example, a cross fin tube type heat exchanger or a cross flow type heat exchanger can be used.

(Accumulator)

The accumulator 6 is arranged on the suction side of the compressor 1 and stores excess refrigerant. The accumulator 6 is a container capable of storing excess refrigerant.

(Supercooling Heat Exchanger)

The supercooling heat exchanger 7 is, for example, a double pipe heat exchanger, and exchanges heat between the refrigerant flowing through the two pipes connected to the supercooling heat exchanger 7.

(Second Expansion Device)

The second expansion device 8 functions as a pressure reducing valve or an expansion valve, and depressurizes and expands the refrigerant. As with the first expansion device 4, the second expansion device 8 is preferably one capable of changing the opening degree, for example, a precise flow control means using an electronic expansion valve, or inexpensive refrigerant flow control means using a capillary tube or the like.

The air-conditioning apparatus according to Embodiment is provided with a controller 20 that performs overall control of the operation of the air-conditioning apparatus, a first temperature sensor 9, and second temperature sensors 10*a* to 10*c*.

A part of the pipe connecting the heat source side heat exchanger 3 and the first expansion device 4 near the heat source side heat exchanger 3 is provided with the first temperature sensor 9. The pipes connecting the heat source side heat exchangers 3*a* to 3*c* and the first flow switching valves 100*a* to 100*c* are provided with the second temperature sensors 10*a* to 10*c*.

(Controller)

The controller 20 controls the driving frequency of the compressor 1, the rotation speed of the fan 30, the switching of the four-way valve 2, the opening degree of each expansion device, and the opening and closing of the first flow switching valves 100*a* to 100*c*, the second flow switching valves 200*a* to 200*c*, and the third flow switching valves 300*a* to 300*c*. That is, the controller 20 is a microcomputer or the like, and controls actuators (driving parts forming the air-conditioning apparatus) and performs operation of the air-conditioning apparatus on the basis of detection information from various detecting devices (not shown) and instructions from a remote controller.

(Temperature Sensors)

The first temperature sensor 9 and the second temperature sensors 10*a* to 10*c* each detect the temperature of the refrigerant flowing through the positions where the sensors are disposed. The temperature information detected by each temperature sensor is sent to the controller 20 that performs overall control of operation of the air-conditioning apparatus, and is used for the control of the actuators forming the air-conditioning apparatus.

(Description of Cycle During Heating Operation)

First, the cycle during heating operation will be described.

The four-way valve 2 is switched to the use side heat exchanger 5 side, the first flow switching valves 100*a* to 100*c* and the second flow switching valves 200*a* to 200*c* are open, whereas the third flow switching valves 300*a* to 300*c* are closed to form a flow path.

The high-temperature and high-pressure gas refrigerant compressed in the compressor 1 is discharged from the compressor 1 and flows through the four-way valve 2 into the use side heat exchanger 5. The refrigerant flowing into the use side heat exchanger 5 radiates heat there, is condensed into a high-pressure two-phase refrigerant, and is expanded by the first expansion device 4 into a low-pressure two-phase refrigerant. After that, the flow of refrigerant is divided into a flow to the second flow switching valves 200*a* to 200*c* and a flow to the second expansion device 8.

The refrigerant flowing to the second flow switching valves 200*a* to 200*c* flows through the second flow switching valves 200*a* to 200*c* into the heat source side heat exchangers 3*a* to 3*c*. After that, the gas refrigerant evaporated in the heat source side heat exchangers 3*a* to 3*c* returns to the compressor 1 through the first flow switching valves 100*a* to 100*c*, the four-way valve 2, and the accumulator 6.

The refrigerant flowing to the second expansion device 8 is expanded and depressurized in the second expansion device 8, then flows into the supercooling heat exchanger 7, and cools the refrigerant flowing to the second flow switching valves 200*a* to 200*c* side. After that, the refrigerant returns to the compressor 1 through the accumulator 6.

(Description of Cycle During Defrosting Operation)

Next, the cycle during defrosting operation will be described.

The defrosting operation of the first heat source side heat exchanger 3*a* will be described below.

The first flow switching valve 100*a* is open, the second flow switching valve 200*a* is closed, and the third flow switching valve 300*a* is open. The first flow switching valves 100*b* and 100*c* are open, the second flow switching valves 200*b* and 200*c* are open, and the third flow switching valves 300*b* and 300*c* are closed.

The flow of high-temperature and high-pressure gas refrigerant compressed in the compressor 1 is divided in the pipe on the discharge side into a flow to the four-way valve 2 and a flow to the third flow switching valve 300*a*.

The refrigerant flowing to the four-way valve 2 flows through the four-way valve 2 into the use side heat exchanger 5. The refrigerant flowing into the use side heat exchanger 5 radiates heat there, is condensed into a high-pressure two-phase refrigerant, and is expanded by the first expansion device 4 into a low-pressure two-phase refrigerant. The refrigerant flows through the second flow switching valves 200*b* and 200*c* into the second heat source side heat exchanger 3*b* and the third heat source side heat exchanger 3*c*, is evaporated and gasified in the second heat source side heat exchanger 3*b* and the third heat source side heat exchanger 3*c*, and then returns to the compressor 1 through the first flow switching valves 100*b* and 100*c*, the four-way valve 2, and the accumulator 6.

The refrigerant flowing to the third flow switching valve 300*a* flows through the third flow switching valve 300*a* into the first heat source side heat exchanger 3*a*. The refrigerant radiates heat there, heats the first heat source side heat exchanger 3*a*, and melts frost. After that, the refrigerant condensed by radiation of heat flows through the first flow switching valve 100*a*, joins the refrigerant evaporated in the second heat source side heat exchanger 3*b* and the third heat source side heat exchanger 3*c*, and returns to the compressor 1 through the four-way valve 2 and the accumulator 6.

The defrosting operation of the first heat source side heat exchanger 3*a* has been described above, and the defrosting of the second heat source side heat exchanger 3*b* or the third heat source side heat exchanger 3*c* is also similarly performed.

Figure 3:
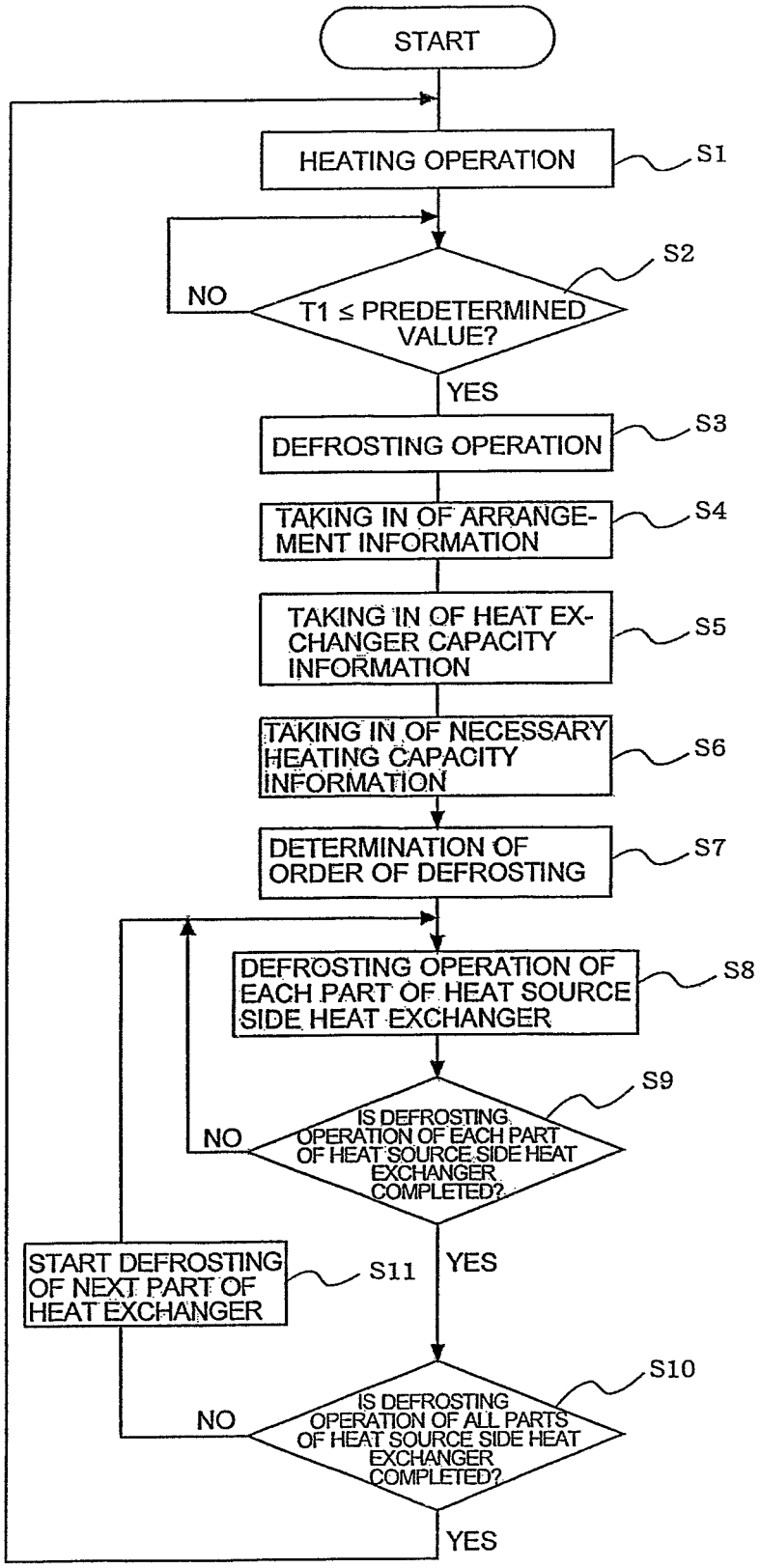
FIG. 3 is a flowchart showing the flow of control during defrosting operation of the air-conditioning apparatus according to Embodiment of the present invention.

FIG. 3 is a flowchart showing the flow of control during defrosting operation of the air-conditioning apparatus according to Embodiment of the present invention.

The characteristic control during defrosting operation performed by the air-conditioning apparatus according to Embodiment will be described in detail with reference to FIG. 3.

First, a heating operation is started in the air-conditioning apparatus (S1).

After the heating operation is started, the controller 20 determines whether or not the temperature T1 detected by the first temperature sensor 9 is lower than or equal to a predetermined value (T1≤predetermined value) (S2).

If the temperature T1 is higher than the predetermined value, the heating operation is continued. If the temperature T1 is lower than or equal to the predetermined value, the heating operation is switched to defrosting operation (S3).

After the heating operation is switched to the defrosting operation, first, the arrangement of the first heat source side heat exchanger 3*a*, the second heat source side heat exchanger 3*b*, and the third heat source side heat exchanger 3*c* of the heat source side heat exchanger 3 is input into the controller 20 (S4). The arrangement differs according to model, and the arrangement is preliminarily stored in a storage device or the like. In the following description, the first heat source side heat exchanger 3*a*, the second heat source side heat exchanger 3*b*, and the third heat source side heat exchanger 3*c* are arranged in this order from the top in the heat source side heat exchanger 3.

Next, the heat exchanger capacity of the first heat source side heat exchanger 3*a*, the second heat source side heat exchanger 3*b*, and the third heat source side heat exchanger 3*c* of the heat source side heat exchanger 3 is input into the controller 20 (S5). The heat exchanger capacity differs according to model, and the heat exchanger capacity is preliminarily stored in a storage device or the like.

Next, the necessary heating capacity information (=heating load) of the first heat source side heat exchanger 3*a*, the second heat source side heat exchanger 3*b*, and the third heat source side heat exchanger 3*c* of the heat source side heat exchanger 3 at that time is input into the controller 20 (S6). The necessary heating capacity is determined by the number and capacity of indoor units, and information on the number and capacity of indoor units is input into the controller 20 through a communicative means or the like.

Receiving the information input in (S4) to (S6), the controller 20 determines the order of defrosting (S7), and defrosts each of the first heat source side heat exchanger 3*a*, the second heat source side heat exchanger 3*b*, and the third heat source side heat exchanger 3*c* of the heat source side heat exchanger 3 (S8).

After that, the controller 20 determines whether or not the defrosting of each of the part 3*a*, 3*b*, or 3*c* of the heat source side heat exchanger being defrosted is completed (S9). For example, when the first heat source side heat exchanger 3*a* is being defrosted, if one of the temperatures T1 and T2 detected by the first temperature sensor 9 and the second temperature sensor 10*a* is lower than or equal to the predetermined value, defrosting is continued, and if both are higher than the predetermined value, defrosting is ended.

The controller 20 determines whether or not the defrosting of all parts (the first part, second part, and third part) 3*a* to 3*c* of the heat source side heat exchanger is completed (S10). If the defrosting of all parts of the heat source side heat exchanger 3*a* to 3*c* is completed, defrosting operation is switched to the heating operation (S1).

If the defrosting of all parts 3*a* to 3*c* of the heat source side heat exchanger is not completed, the controller 20 starts the defrosting of the next part 3*a*, 3*b*, or 3*c* of the heat source side heat exchanger (S11), and continues defrosting operation (S8).

Next, how to determine the order of defrosting of the first heat source side heat exchanger 3*a*, the second heat source side heat exchanger 3*b*, and the third heat source side heat exchanger 3*c* of the heat source side heat exchanger 3 in (S7) will be described.

If, from the heat exchanger capacity information obtained in (S5), the heat exchanger capacity of the first heat source side heat exchanger 3*a*≥the heat exchanger capacity of the second heat source side heat exchanger 3*b*≥the heat exchanger capacity of the third heat source side heat exchanger 3*c*, the order of defrosting is determined as shown in Table 1. The defrosting of the third part is performed first, and then the defrosting of the first part is performed so that the heat exchangers do not receive drain water in a frosted state.

If the necessary heating capacity is high (S6), the defrosting of the third heat source side heat exchanger 3*c* is performed first (S7-1), then the defrosting of the second heat source side heat exchanger 3*b* is performed (S7-2), and finally the defrosting of the first heat source side heat exchanger 3*a* is performed (S7-3).

If the necessary heating capacity is medium or low (S6), the defrosting of both the second heat source side heat exchanger 3*b* and the third heat source side heat exchanger 3*c* is performed first (S7-1), and then the defrosting of the first heat source side heat exchanger 3*a* is performed (S7-2).

TABLE 1

| S4 | S5 Heat exchanger | S6 Necessary heating | | S7 Order of defrosting | | |
|---|---|---|---|---|---|---|
| Arrangement | capacity | capacity | | S7-1 | S7-2 | S7-3 |
| Upper 3a | 3a ≥ 3b ≥ 3c | High | → | 3c | 3b | 3a |
| Middle 3b | | Medium | | 3b + 3c | 3a | None |
| Lower 3c | | Low | | 3b + 3c | 3a | None |

If, from the heat exchanger capacity information obtained in (S7), the heat exchanger capacity of the first heat source side heat exchanger 3*a*≤the heat exchanger capacity of the second heat source side heat exchanger 3*b*≤the heat exchanger capacity of the third heat source side heat exchanger 3*c*, the order of defrosting is determined as shown in Table 2.

If the necessary heating capacity is high (S6), the defrosting of the third heat source side heat exchanger 3*c* is performed first (S7-1), then the defrosting of the second heat source side heat exchanger 3*b* is performed (S7-2), and finally the defrosting of the first heat source side heat exchanger 3*a* is performed (S7-3).

If the necessary heating capacity is medium or low (S6), the defrosting of the third heat source side heat exchanger 3*c* is performed first (S7-1), and then the defrosting of both the first heat source side heat exchanger 3*a* and the second heat source side heat exchanger 3*b* is performed (S7-2).

TABLE 2

| S4 | S5 Heat exchanger | S6 Necessary heating | | S7 Order of defrosting | | |
|---|---|---|---|---|---|---|
| Arrangement | capacity | capacity | | S7-1 | S7-2 | S7-3 |
| Upper 3a | 3a ≤ 3b ≤ 3c | High | → | 3c | 3b | 3a |
| Middle 3b | | Medium | | 3c | 3a + 3b | None |
| Lower 3c | | Low | | 3c | 3a + 3b | None |

When the heat source side heat exchanger is divided vertically into two parts, the order of defrosting is determined as shown in Table 3. In Table 3, assume that an upper heat source side heat exchanger 3*a*' is placed in the upper part and a lower heat source side heat exchanger 3*b*' is placed in the lower part.

In the case of two (upper and lower) heat source side heat exchangers, regardless of heat exchanger capacity and necessary heating capacity, the defrosting of the lower heat source side heat exchanger 3*b*' in the lower part is performed first.

TABLE 3

| S4 | S5 Heat exchanger | S6 Necessary heating | | S7 Order of defrosting | | |
|---|---|---|---|---|---|---|
| Arrangement | capacity | capacity | | S7-1 | S7-2 | S7-3 |
| Upper 3a' | No object | High | → | 3b' | 3a' | None |
| Lower 3b' | | Medium | | 3b' | 3a' | None |

As described above, the order of defrosting is determined according to the arrangement of vertically divided heat source side heat exchangers, the heat source side heat exchanger capacity, and the necessary heating capacity. That is, the defrosting operation of the heat source side heat exchanger in the lower part is performed first, and then the defrosting operation of the heat source side heat exchanger in the upper part is performed. Thus, passages for dropping drain water is secured in the lower part, drain water generated by defrosting the heat source side heat exchanger in the upper part can be quickly discharged, and the frost on the heat source side heat exchanger can be reliably melted. Therefore, the heating capacity can be maintained.

The invention claimed is:

1. An air-conditioning apparatus comprising:

a compressor;

a first set of open-close valves;

a heat source side heat exchanger comprising a plurality of vertically arranged heat source side heat exchanger parts including a first heat source side heat exchanger part, a second heat source side heat exchanger part and a third heat source side heat exchanger part, the second heat source side heat exchanger part extending between the first and third heat source side heat exchanger parts;

a second set of open-close valves;

a first expansion device;

a use side heat exchanger;

a third set of open-close valves;

pipes;

a temperature sensor arranged in one pipe of the pipes;

a storage device configured to store input data concerning a heat exchanger capacity for each of the vertically arranged heat source side heat exchanger parts, arrangement of each of the vertically arranged heat source side heat exchanger parts relative to each other, and number and capacity of indoor units; and a controller configured to control opening and closing of each open-close valve of the first set of open-close valves, the second set of open-close valves, the third set of open-close valves, and the first expansion device, the compressor, the first set of open-close valves, the heat source side heat exchanger, the second set of open-close valves, the first expansion device, and the use side heat exchanger being connected in series by the pipes, the compressor, the third set of open-close valves, the heat source side heat exchanger, and the first set of open-close valves being connected in series by the pipes, each of the vertically arranged heat source side heat exchanger parts being connected to one first open-close valve of the first set of open-close valves, one second open-close valve of the second set of open-close valves, and one third open-close valve of the third set of open-close valves by the pipes, wherein the controller is configured:

to perform a heating operation by controlling the air-conditioning apparatus including receiving a measured temperature from the temperature sensor, to switch from the heating operation to a defrosting operation, to retrieve the input data for the vertically arranged heat source side heat exchanger parts, to determine heating load requirements of the heat source side heat exchanger parts, to determine a defrosting order in which the heat source side heat exchanger parts are defrosted on the basis of the heat exchanger capacity of the heat source side heat exchanger parts, the heating load requirements of the heat source side heat exchanger parts, and the arrangement of the heat source side heat exchanger parts, the determined defrosting order being selected from the group consisting of a first defrosting order and a second defrosting order each of which inhibit water and melted frost from one of the heat source side heat exchanger parts from contacting another of the heat source side heat exchanger parts, the first defrosting order requires firstly defrosting at least one of the second and third heat side heat exchanger parts and lastly defrosting the first heat side heat exchanger part, and a second defrosting order requires firstly defrosting the third heat side heat exchanger part and lastly defrosting at least one of the first and second heat side heat exchanger parts, and to perform a defrosting operation by controlling refrigerant discharged from the compressor through each of the heat source side heat exchanger parts by controlling the opening and closing of the one first open-close valve of the first set of open-close valves, the one second open-close valve of the second set of open-close valves, and the one third open-close valve of the third set of open-close valves of each vertically arranged heat source side heat exchanger part and defrosting the heat source side heat exchanger parts in the determined defrosting order.

2. The air-conditioning apparatus of claim 1, wherein the first, second, and third heat source side heat exchanger parts are vertically arranged in series, and the defrosting order in which the heat source side heat exchanger parts are defrosted includes firstly defrosting of a lower heat source side heat exchanger part of the first, second, and third heat source side heat exchanger parts.

3. The air-conditioning apparatus of claim 1, wherein the first, second and third heat source side heat exchanger parts have different heat exchanger capacities and are arranged in one of a first arrangement and a second arrangement as set forth below:

the first arrangement requires that the heat exchanger capacity of the first heat source side heat exchanger part is greater than or equal to the heat exchanger capacity of the second heat source side heat exchanger part, and the heat exchanger capacity of the second heat source side heat exchanger part is greater than or equal to the heat exchanger capacity of the third heat source side heat exchanger part, and the second arrangement requires that the heat exchanger capacity of the first heat source side heat exchanger part is less than or equal to the heat exchanger capacity of the second heat source side heat exchanger part, and the heat exchanger capacity of the second heat source side heat exchanger part is less than or equal to a heat exchanger capacity of the third heat source side heat exchanger part, and the controller is configured to:

in the first arrangement of the first, second and third heat source side heat exchanger parts, defrost the third heat source side heat exchanger part first, and in the second arrangement of the first, second and third heat source side heat exchanger parts, defrost the second and third heat source side heat exchanger parts lastly and simultaneously.

4. The air-conditioning apparatus of claim 1, wherein the first defrosting order includes firstly and simultaneously defrosting the first and second heat source side heat exchanger parts and the second defrosting order includes lastly and simultaneously defrosting the second and third heat source side heat exchanger parts.

5. The air-conditioning apparatus of claim 1, wherein the first, second, and third heat source side heat exchanger parts each have a different heat exchanger capacity.

6. An air-conditioning apparatus comprising:

a compressor;

a first set of open-close valves;

a heat source side heat exchanger;

a second set of open-close valves;

a first expansion device;

a use side heat exchanger;

a third set of open-close valves;

pipes;

a first temperature sensor arranged in one pipe of the pipes provided between the heat source side heat exchanger and the first expansion device;

a storage device configured to store input data concerning a heat exchanger capacity for each of the vertically arranged heat source side heat exchanger parts, arrangement of each of the vertically arranged heat source side heat exchanger parts relative to each other, and number and capacity of indoor units; and a controller configured to control opening and closing of each open-close valve of the first set of open-close valves, the second set of open-close valves, the third set of open-close valves, and the first expansion device, the compressor, the first set of open-close valves, the heat source side heat exchanger, the second set of open-close valves, the first expansion device, and the use side heat exchanger being connected in series by the pipes, the compressor, the third set of open-close valves, the heat source side heat exchanger, and the first set of open-close valves being connected in series by the pipes, the heat source side heat exchanger comprising a plurality of vertically arranged heat source side heat exchanger parts, each of the vertically arranged heat source side heat exchanger parts being connected to one first open-close valve-of the first set of open-close valves, one second open-close valve of the second set of open-close valves, and one third open-close valve of the third set of open-close valves-by the pipes, wherein the controller is configured:

to perform a heating operation by controlling the air-conditioning apparatus including receiving a measured temperature from the first temperature sensor, to switch from the heating operation to a defrosting operation when the received measured temperature is lower than a predetermined temperature value, to retrieve the input data for the vertically arranged heat source side heat exchanger parts from the storage device, to determine heating load requirements of the heat source side heat exchanger parts, to determine a defrosting order in which the heat source side heat exchanger parts are defrosted on the basis of the retrieved heat exchanger capacity of the heat source side heat exchanger parts, the determined heating load requirements of the heat source side heat exchanger parts, and the arrangement of the heat source side heat exchanger parts; the determined defrosting order being selected from a plurality of different defrosting orders to inhibit water and melted frost from one of the heat source side heat exchanger parts from contacting another of the heat source side heat exchanger parts; the plurality of different defrosting orders being selected from the group consisting of a first defrosting order including defrosting the third heat source side heat exchanger part before the second heat source side heat exchanger part, a second defrosting order including defrosting the second heat source side heat exchanger part before the first heat source side heat exchanger part, and a third defrosting order including defrosting the third heat source side heat exchanger part before the first heat exchanger part; and to perform the defrosting operation in which a refrigerant discharged from the compressor is caused to flow through each of the heat source side heat exchanger parts by controlling the opening and closing of the one first open-close valve of the first set of open-close valves, the one second open-close valve of the second set of open-close valves, and the one third open-close valve of the third set of open-close valves of each vertically arranged heat source side heat exchanger part and defrost the heat source side heat exchanger parts in the determined defrosting order, and wherein the controller receives a first measured temperature from the first temperature sensor and is further configured to continue a heating operation when the received first temperature is greater than the predetermined temperature value and to switch to the defrosting operation when that first measured temperature is lower than the predetermined temperature value.

7. The air-conditioning apparatus of claim 6, further comprising:

a second temperature sensor arranged in another pipe of the pipes between the heat source side heat exchanger and the first set of open-close valves, wherein the controller receives a second measured temperature from the second temperature sensor and is further configured:

to continue the defrosting operation if one of the first and second measured temperatures is lower than or equal to the predetermined temperature value, and to cease the defrosting operation if both of the first and second measured temperatures are higher than the predetermined temperature value.

8. The air-conditioning apparatus of claim 6, wherein the first, second, and third heat source side heat exchanger parts each have a different heat exchanger capacity.

* * * * *